US009217217B2

(12) United States Patent
Kasack et al.

(10) Patent No.: US 9,217,217 B2
(45) Date of Patent: Dec. 22, 2015

(54) DOOR-LOCKING DEVICE FOR A HOUSEHOLD APPLIANCE, DOOR ARRANGEMENT COMPRISING A DOOR-LOCKING DEVICE AND METHOD FOR LOCKING A DOOR OF A HOUSEHOLD APPLIANCE

(75) Inventors: Andreas Kasack, Berlin (DE); Christian Sechelmann, Brieselang (DE)

(73) Assignee: BSH HAUSGERÄTE GMBH, Munich (DE)

( * ) Notice: Subject to any disclaimer, the term of this patent is extended or adjusted under 35 U.S.C. 154(b) by 1144 days.

(21) Appl. No.: 12/997,911

(22) PCT Filed: Jun. 18, 2009

(86) PCT No.: PCT/EP2009/057603

§ 371 (c)(1),
(2), (4) Date: Dec. 14, 2010

(87) PCT Pub. No.: WO2010/000626

PCT Pub. Date: Jan. 7, 2010

(65) Prior Publication Data

US 2011/0101840 A1 May 5, 2011

(30) Foreign Application Priority Data

Jun. 30, 2008 (DE) ..... 10 2008 030 902

(51) Int. Cl.

| | |
|---|---|
| ***E05C 19/10*** | (2006.01) |
| ***D06F 37/42*** | (2006.01) |
| ***D06F 39/14*** | (2006.01) |

(52) U.S. Cl.

CPC ..... *D06F 37/42* (2013.01); *D06F 39/14* (2013.01); *Y10T 292/08* (2015.04); *Y10T 292/0895* (2015.04); *Y10T 292/1021* (2015.04)

(58) Field of Classification Search

USPC ..... 292/341.15, DIG. 69, 341.16, 144, 137; 200/61.64

See application file for complete search history.

(56) References Cited

U.S. PATENT DOCUMENTS

| | | | | |
|---|---|---|---|---|
| 2,868,577 | A * | 1/1959 | Zingone | 292/99 |
| 4,365,830 | A * | 12/1982 | Paulson | 292/89 |
| 6,634,684 | B2 * | 10/2003 | Spiessl | 292/341.16 |

(Continued)

FOREIGN PATENT DOCUMENTS

| | | | |
|---|---|---|---|
| DE | 102006058322 | A1 | 6/2008 |
| EP | 0965677 | A1 | 12/1999 |
| EP | 1467048 | A1 | 10/2004 |

OTHER PUBLICATIONS

Report of Examination EP 09772326.6, dated Dec. 4, 2012.

*Primary Examiner* — Mark Williams
(74) *Attorney, Agent, or Firm* — Nixon & Vanderhye P.C.

(57) ABSTRACT

A door locking device for a household appliance is provided. The door locking device includes a base member that has a receptacle; a closing element on a door side that is moved into the receptacle when a door of the household appliance is closed; a control unit; an electrical switch that is switched over in a closed position of the closing element and via which an information signal signaling the closed position of the closing element is transmitted to the control unit; and an interlocking device to mechanically interlock the door. The mechanical interlocking of the door is facilitated in an interlock position of the closing element and the closing element is moved from the interlock position into the closed position when the door is closed.

19 Claims, 9 Drawing Sheets

(56) References Cited

U.S. PATENT DOCUMENTS

| | | | | |
|---|---|---|---|---|
| 7,549,685 | B2 | 6/2009 | Mueller et al. | |
| 7,775,070 | B2 * | 8/2010 | Lim et al. | 68/12.26 |
| 2009/0039657 | A1 | 2/2009 | Schuck | |
| 2009/0212677 | A1 | 8/2009 | Kocak et al. | |

* cited by examiner

DOOR-LOCKING DEVICE FOR A HOUSEHOLD APPLIANCE, DOOR ARRANGEMENT COMPRISING A DOOR-LOCKING DEVICE AND METHOD FOR LOCKING A DOOR OF A HOUSEHOLD APPLIANCE

This application is a U.S. National Phase of International Application No. PCT/EP2009/057603, filed Jun. 18, 2009, which designates the U.S. and claims priority to German Application No. 10 2008 030 902.8, filed Jun. 30, 2008, the entire contents of each are hereby incorporated by reference.

BACKGROUND OF THE INVENTION

The invention relates to a door-locking device for a household appliance, comprising a base member with a receptacle into which a closing element on the door side can move when the door of the household appliance is closed, an electric switch that can switch to a closed position of the closing element and that can transmit to a control unit an information signal indicating the closed position of the closing element and comprising an interlocking device for mechanically interlocking the door, wherein the mechanical interlocking is possible in an interlock position of the closing element. The invention further relates to a door arrangement comprising such a door locking device. The invention finally relates to a method for locking a door of a household appliance using such a door locking device.

With such a door locking device for a household appliance for laundry care, after the door (also referred to as the window) has been closed, an electrical switch is closed which has the task of signaling to a control unit of the household appliance that a closed position of the door has been reached. In this closed position the mechanical interlocking of the door must have already been made possible by an interlocking device so that the electrical switch remains closed for a door that is already interlocked. In this case the closed position, in which the electrical switch is closed can for constructional reasons not be provided at the same place as the interlock position in which the mechanical interlocking of the door is made possible. For these reasons first the closed position and then the interlock position is assumed when the door is closed. The result achieved by this is that, when an attempt is made to open the door by a user in an interlocked state of the door, the electrical switch is not inadvertently opened.

As from September 2006 BSH Bosch und Siemens Hausgeräte GmbH has been marketing washing machines under the brand names Bosch and Siemens each of which features a door locking device of the generic type described above.

Door locking devices can also be found in the two documents WO 2006/122842 A1 and WO 2007/065793 A1.

One of the current BSH Bosch und Siemens Hausgeräte GmbH door locking devices 1 for a household laundry care appliance is shown in schematic diagrams in FIGS. 1 to 6. These diagrams show the different positions of a door-side closing element 2, which on closure of a door of the household appliance, is able to be moved into a corresponding receptacle 3 of a base member 4. The base member 4 can for example be a part of a housing of the household appliance. This door locking device 1 features a sliding element 5 which is able to be moved in relation to the base member 4. The sliding element 5 has a receptacle opening 6 to accept the closing element 2 which directly adjoins the receptacle 3 of the base member 4. It should be mentioned at this point that the closing element 2 is supported pivotably on the door of the household appliance and has a positioning force applied to it, for example is spring-loaded. This means that the closing element 2 can be hinged from a basic position shown in FIG. 1 into a hinged position shown in FIG. 2, with the positioning force making sure that the closing element 2 is able to be moved automatically from the hinged position into the basic position. With this door locking device 1 the sliding element 5 is able to be moved when the closing element 2 is moved into the receptacle opening 6 by an exertion of a force effected by the closing element 2 on a side wall of the receptacle opening 6. This force is attributable to the positioning force that is applied to the closing element 2.

This door locking device 1 further features an electrical switch 8 which is formed by a contact element pair including a first and a second contact element 9, 10. The first and the second contact element 9, 10 are held in this case on the base member 4 and/or on the housing of the household appliance and are also embodied to be flexible or elastic and springy respectively. With this door locking device 1 the electrical switch 8 is able to be switched by means of the sliding element 5 into its closed switching position. For this purpose the sliding element 5 has a flange-type protrusion 11 projecting from it by means of which the first contact element 9 is bent and can thus be moved towards the second contact element 10 in order to establish an electrical connection between the first and the second contact element 9, 10. If the closing element 2 effects a movement of the sliding element 5, the electrical switch 8 can be closed. In this case the switching of the electrical switch 8 into its closed switching state occurs in a closed position of the closing element 2 in the receptacle 3, i.e. accordingly in a closed position of the sliding element 5 in relation to the base member 4. The fact that the closed position of the closing element 2 has been achieved is signaled to a control unit of the household appliance via the electrical switch 8.

This door locking device 1 further comprises an interlocking device 12 having an interlocking element 13 which is able to the inserted into a corresponding opening 14 of the sliding element 5. In this case the interlocking element 13 can only be inserted into the corresponding opening 14 of the sliding element 5 if an interlock position of the closing element 2 shown in FIG. 4 and correspondingly an interlock position of the sliding element 5 in relation to the interlocking element 13 is passed. Furthermore an electrical interlocking switch 15 is assigned to the interlocking device 12 which is formed by a contact element pair including a first and a second contact element 16, 17. In this case the first and the second contact element 16, 17 of the interlocking switch 15 are held on the base member 4 and/or on the housing of the household appliance and are embodied flexibly or elastically and springy respectively. In addition the first contact element 16 is pretensioned by means of the interlocking element 13 and in more precise terms by means of a flange-type lug 18 protruding from said element, so that on insertion of the interlocking element 13 into the opening 14 of the sliding element 5 the first contact element 16 is automatically caused to move towards the second contact element 17 to make an electrical connection between the first and the second contact element 16, 17. The electrical interlocking switch 15 in this case has the task of signaling to a control unit of the household appliance the locked state of the door.

A closing process of the door of the household appliance is explained below in greater detail with reference to FIGS. 1 to 6. In a position of the closing element 2 depicted in FIG. 1 the electrical switch 8 as well as the electrical interlocking switch 15 is opened and the mechanical locking of the door is not possible because of the displaced position of the opening 14 in relation to the interlocking element 13. This position of the closing element 2 corresponds to an open position of the door of the household appliance. When the door is closed the closing element is moved into the receptacle 3 of the base member 4 as well as into the receptacle opening 6 of the sliding element 5 and thus, as a result of the positioning force, causes the sliding element 5 to move in relation to the base member 4. A closed position of the closing element 2 is shown in FIG. 2, in which the electrical switch 8 is switched into its closed or electrically-conductive switching state. The time of actuation of the electrical switch 8 or of reaching the closed position of the closing element 2 is not fixed in this case but depends on the mechanical tolerances, especially on construction and manufacturing-related variations in shape and position of the electrical switch 8 and of the flange-type projection 11. Referring to FIG. 7, a first Gaussian curve 19 represents a probability density of the probability of reaching the closing position of the closing element 2 or the closing of the electrical switch 8 as a function of the current position S of the closing element 2 on closing the door of the household appliance. As FIG. 7 shows, when a first position 51 of the closing element 2 is passed, the closed position of said element is very probably reached, i.e. it is highly likely that the electrical switch 8 is closed. In this case the shape, especially the width of the first Gaussian curve 19, is determined by the mechanical tolerances.

Again referring to FIG. 2, in the closed position of the closing element 2 the mechanical interlocking of the door of the household appliance is not yet possible because of the displaced position of the opening 14 in relation to the interlocking element 13. A further position of the closing element 2 after the closed position of the same is shown in FIG. 3. Although in this position of the closing element 2 in accordance with FIG. 3 the mechanical interlocking the door is not yet guaranteed, this is however likewise dependent on the build tolerances, such as especially on the shape and position tolerances of the sliding element 5 and of the interlocking element 13. Shown in FIG. 7 by a second Gaussian curve 20 is a probability density of the probability of reaching the interlock position of the closing element 2 as a function of the current position S of the same. As is shown in FIG. 7, the interlock position of the closing element 2, in which the mechanical interlocking of the door is made possible, is very probably reached at a position S2 of the closing element 2. This position S2 corresponds to the position of the closing element 2 which is reproduced in FIG. 4. On reaching the interlock position of the closing element 2 shown in FIG. 4, both the electrical switch 8 is closed and also the mechanical interlocking of the door is made possible. A further position of the closing element 2 which corresponds to an end position of the same, is shown in FIGS. 5 and 6. As can be seen from these figures, the interlocking element 13 can be guided into the opening 14 and can be withdrawn from said opening. In this end position the mechanical interlocking the door is assured, i.e. is possible with a probability equal to almost one, which is shown with reference to an interlocking curve 21 in FIG. 7. In this case the interlocking curve 21 can assume two different values, a value V1 and also a value V2. If the interlocking curve 21 assumes the value V2, the mechanical interlocking of the door of the household appliance is made possible. By contrast the value V1 means that the probability of reaching the interlock position of the closing element 2 is less than 1. Further referring to FIG. 7, a switching curve 22 represents possible switching states of the electrical switch 8. In this case a value X1 corresponds to the open switching state and a value X2 to the closed switching state of the electrical switch 8. As is shown in FIG. 7, one hundred percent information about the closed switching state of the electrical switch 8 can only be provided at the end of the first Gaussian curve 19, i.e. when the closed position of the closing element 2 is reached with the probability equal to almost one. The end position of the closing element 2 in which the electrical switch 8 is closed and the mechanical interlocking of the door is made possible is labeled S3 in FIG. 7.

As stated above, with this door locking device 1, first the closing position in which the electrical switch 8 is closed and then the interlock position, in which the mechanical interlocking of the door is made possible, is achieved. The situation which is to be seen as a disadvantage for this door locking device 1 is the situation in which for a closed electrical switch 8 via which the closed position of the closing element 2 is able to be signaled to the control unit, the mechanical interlocking of the door is not always made possible. Because of the build tolerances mentioned, there are states in which the closed position is signaled to the control unit via the closed electrical switch 8 but the mechanical interlocking of the door and thus the closing of the electrical interlocking switch 15 is not possible however, so that a process of the household appliance, such as a wash cycle for example, cannot be started.

The underlying object of the present invention is to create a door locking device for a household appliance, a door arrangement with such a door locking device and also a method for locking a door of a household appliance, wherein measures are taken which guarantee that the mechanical interlocking of the door is able to the carried out in an operationally-secure manner when the electrical switch is closed.

BRIEF SUMMARY OF THE INVENTION

This object is inventively achieved by a door locking device, by a door arrangement and also by a method each with the features of the corresponding independent claim. Advantageous embodiments of the invention are specified in the dependent claims.

An inventive door locking device for a household appliance comprises a base member, having a receptacle into which a door-side closing element is able to be moved when the door of the household appliance is closed. The door locking device further comprises an electrical switch which is able to be switched over in a closed position of the closing element and via which an information signal signaling the closed position of the closing element is able to be transmitted to a control unit. The door locking device further features an interlocking device for mechanically locking the door, whereby the mechanical locking is made possible in an interlock position of the closing element. Inventively there is provision for the closing element to be able to be moved on closure of the door from the interlock position into the closed position.

The present invention is thus based on the knowledge that the mechanical locking of the door is made possible in an operationally-secure manner when the electrical switch is closed if first of all the interlock position of the closing element, in which the mechanical interlocking of the door is possible, and subsequently the closed position, in which the electrical switch is closed, are reached. States of the door locking device are thus avoided in which the mechanical interlocking of the door is not possible with a closed electrical switch because of the component tolerances. A secure starting of a process of the household appliance is thus guaranteed.

Preferably, in the inventive door locking device, the switch is able to the switched over into a closed switch state in the closed position of the closing element.

In order to guarantee that the electrical switch remains safely switched over for a door interlocked by means of the interlocking device, there is provision in one form of embodiment for the electrical switch to be switched over in an open position of the switch element on the opening of the door, whereby the closing element on opening the door is able to be moved out of the interlock position into the open position. In other words, when the door is opened, the interlock position in which mechanical interlocking and unlocking is still possible and then the open position in which the electrical switch is switched over are achieved. This fulfills the requirements for the electrical switch to remain safely switched over when the door is interlocked. In this form of embodiment a switching characteristic of the electrical switch is thus defined as a function of a current position of the closing element by a hysteresis, in which especially a rising edge corresponds to switching the electrical switch into its closed switch state and a falling edge to switching the electrical switch into its open switch state. In other words the rising edge of the hysteresis designates the reaching of the closed position of the closing element and the falling edge the reaching of the open position of the same. Preferably the rising and the falling edge of the hysteresis are matched in relation to the current position of the closing element to each other such that the interlock position of the closing element is achieved on moving the same between the closed position and the open position, even taking account of the component tolerances, with a probability equal to almost one.

Equally preferably in the inventive door locking device the electrical switch is able to be switched over in an open position of the closing element into an open switch state on opening the door.

This type of hysteresis can for example be achieved by the electrical switch being embodied as a spring switch. In this case the characteristic of a spring switch is that its force-movement characteristic is defined by a hysteresis. At the beginning of the actuation of the electrical switch the force necessary for switching the electrical switch thus increases comparatively strongly, whereby the electrical switch, at the time of switching, suddenly snaps into its closed switching state so that the actuation force falls accordingly. When a spring switch is switched into its open switching state the actuation force usually increases again, which is attributable to a reset force, which on removal of the load puts the spring switch back into its initial position.

Preferably the electrical switch comprises a pair of contact elements of which one contact element is connected to an actuation element via a spring element which is able to be actuated at least indirectly by the closing element. In particular the contact element acts via the spring element in conjunction with the actuation element so that the electrical switch, on reaching the closed position, is abruptly switched into its closed or open switching state. By this and especially by using the spring element which connects the actuation element to the contact element, a spring switch is created the switching characteristics of which exhibit a hysteresis as a function of the current position of the closing element.

In a form of embodiment there is provision for the door locking device to include a sliding element which is able to be moved by means of the closing element in relation to the base member and by means of which the electrical switch is able to be switched. In this case there can be provision for the sliding element to have a flange-type projection protruding from said element, by means of which the electrical switch is able to be switched. Preferably the sliding element, especially the flange-type projection, actuates the actuation element of the electrical switch, which in its turn actuates a contact element of a pair of contact elements and thus causes the electrical switch to switch over. By using a flange-type projection an especially operationally-secure as well as shake-proof actuation of the electrical switch can be guaranteed in this case.

As an alternative to the spring switch there can be provision for the door locking device to have an electrical switch which is formed as a combination of two conventional electrical switches, with the conventional electrical switches able to be switched in different positions of the closing element. Thus in particular the first electrical switch can be switched on closing the door before the interlock position is reached into its closed switching state and the second electrical switch can be switched into its closed switching state after the interlock position state is reached. Accordingly the second electrical switch can be opened on opening the door before and the first electrical switch after the interlock position has been passed. In this form of embodiment the control unit can be embodied to evaluate the signals transferred via the first and the second electrical switch and to operate the household appliance as a function of the evaluation.

In a preferred manner there is provision for the sliding element to have a receptacle opening for accepting the closing element and to be able to be moved by an exertion of a force on the side wall of the receptacle opening brought about by the closing element. The provision of the sliding element including the receptacle opening for receiving the closing element is based in particular on the knowledge that the closing element is supported pivotably on a door of the household appliance and has a positioning force applied to it. Thus the sliding element can be moved in a technically simple manner by the inwards movement of the closing element into the receptacle opening and the electrical switch can be switched accordingly.

It has proved to be especially advantageous for the locking device to have an opening embodied in the sliding element in which a corresponding interlocking element, especially a locking bolt, is able to be introduced in the interlock position of the closing element. Thus the sliding element and thereby the door of the household appliance can be locked in an operationally secure manner by the introduction of the locking element into the corresponding opening.

In particular the interlocking device is assigned an electrical interlocking switch which, when the door is locked, i.e. especially on the introduction of the interlocking element into the opening of the sliding element, is able to be switched into a closed switching state. Thus an information signal can be transferred to a control unit of the household appliance which signals the interlocking of the door.

A household appliance is particularly to be understood here as a household appliance for laundry care such as a washing machine, a tumble dryer or a washer-dryer for example.

An inventive door arrangement for a household appliance comprises the door with a closing element as well as a household appliance-side inventive door locking device. The term door arrangement is especially to be understood as a door frame which is formed by a part of the housing of the household appliance as well as a door of the household appliance belonging to said frame. Advantageous embodiments of the inventive door locking device are to be seen as advantageous embodiments of the inventive door arrangement.

An inventive method is designed for locking a door of a household appliance with the aid of a door locking device. In the method a door-side closing element is moved into a receptacle of the door locking device when the door is closed. Furthermore an electrical switch, by which a control unit has an information signal transferred to it signaling a closed position of the closing element, is switched when the closing position of the closing element is reached and a mechanical interlocking of the door is made possible by means of an interlocking device in an interlock position of the closing element. An important idea in the inventive method consists of the closing element being moved on closure of the door from the interlock position into the closed position.

Advantageous embodiments of the inventive door locking device and their advantages apply correspondingly to the inventive method.

BRIEF DESCRIPTION OF THE DRAWINGS

Further advantages, features and details of the invention emerge from the subsequent description of a preferred exemplary embodiment as well as with reference to the enclosed drawings. The drawings show.

DETAILED DESCRIPTION OF EXEMPLARY EMBODIMENTS OF THE PRESENT INVENTION

Figure 1:
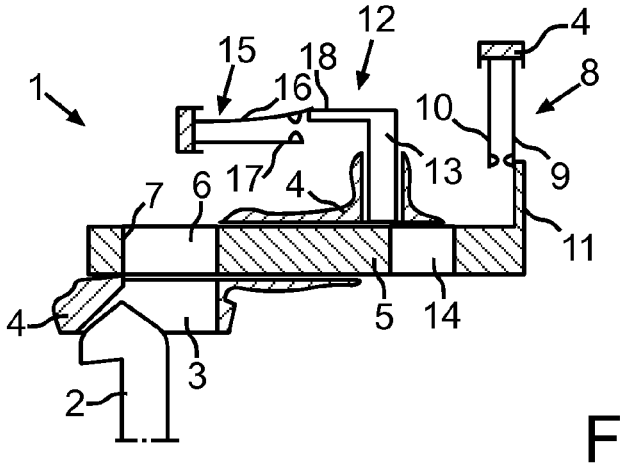
FIG. 1 to FIG. 6 a schematic cross-sectional view through a door locking device in accordance with the prior art with a closing element being located in different positions.
Figure 2:
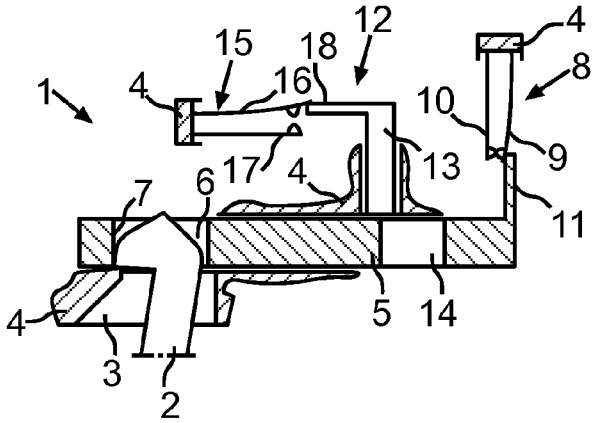
Figure 3:
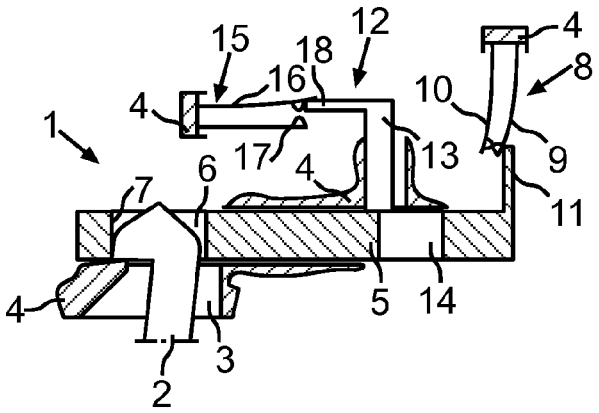
Figure 4:
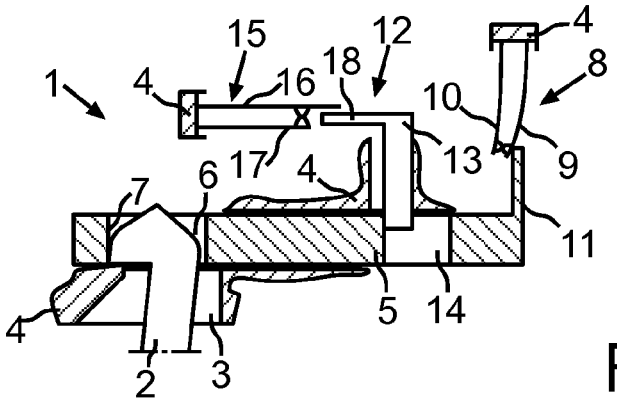
Figure 5:
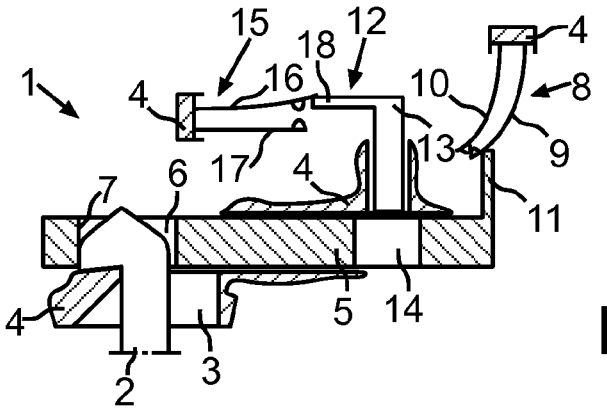
Figure 6:
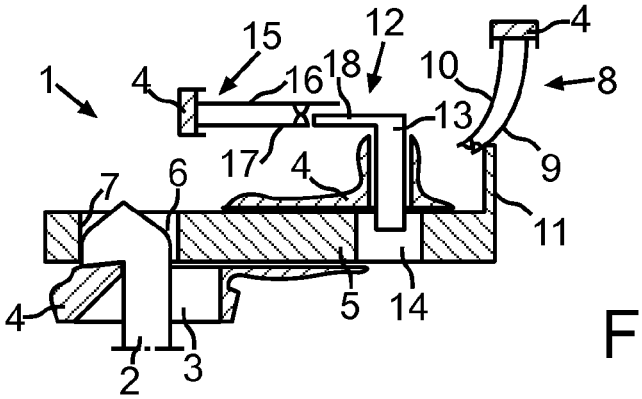
Figure 7:
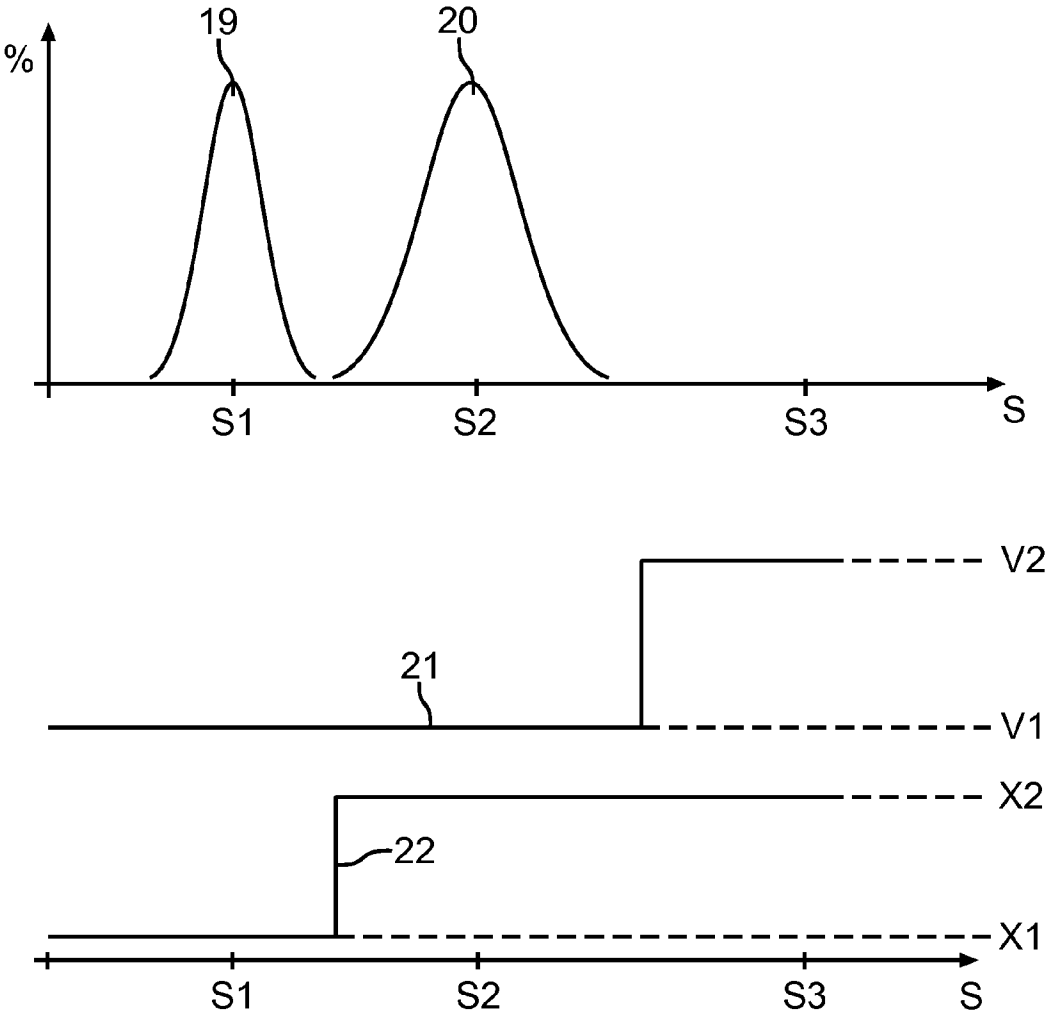
FIG. 7 curves of a probability density of a probability of reaching an closing position as well as an interlock position of the closing element as a function of the current position of the same, a graph of a curve characterizing the possibility of an interlocking of a door as well as a graph of a curve characterizing a switching state of an electrical switch during operation of the door locking device in accordance with FIGS. 1 to 6 according to the prior art.

Identical elements or elements with the same functions are provided with the same reference signs in the figures.

The door locking device 1 to be considered below with reference to FIGS. 8 to 24 essentially corresponds to the door locking device 1 in accordance with FIGS. 1 to 6, with the electrical switch 8 being embodied in the example as a spring switch. With reference to FIGS. 8 to 15, a closing process of the door of a household appliance to which the door locking device 1 is fitted is subsequently explained in greater detail. The electrical switch 8 now features an actuation element 23 which is connected via a spring element 24, for example a helical spring, with the second contact element and interacts with this. In this case the flange-type projection 11 and the electrical switch 8 are matched to each other such that a displacement of the sliding element 5 effected by moving the closing element 2 into the receptacle opening 6 of the sliding element 5 and thus of the flange-type projection 11 brings about an actuation of the actuation element 23. Furthermore the actuation element 23, like the first and the second contact element 9, 10, is held on the base member 4 and/or on the housing of the household appliance and is embodied elastically or flexibly and springy. The second contact element 10 and the actuation element 23 are pre-tensioned by means of the spring element 24 such that they are bent away from one another. If the actuation element 23 is pressed or pushed in the direction of the second contact element 10, the force acting from the spring element 24 on the actuation element 23 and thus the force necessary for actuation increases. If the actuation element 23 reaches the second contact element 10, the electrical switch 8 snaps abruptly into its closed switching position, in which an electrical connection is established between the first and the second contact element 9, 10. The electrical switch 8 can be switched again into its open switching state by the load acting on the actuation element 23 being removed or by the sliding element 5 being pushed back. On opening the electrical switch 8 by removal of the load acting on the actuation element 23, there is also an abrupt snapping over of the electrical switch 8 when the actuation element 23 passes the second contact element 10. It should be mentioned at this point that an abrupt snapping over of the electrical switch 8 is caused by the spring element 24. If a position of the actuation element 23 in which the actuation element 23, on closure of the electrical switch 8, reaches the second contact element 10 is referred to as a closing position of the actuation element 23, and a position in which the actuation element 23, on opening of the electrical switch 8, passes the second contact element 10 is referred to as an open position, the closed position lies on a path coordinate of the actuation element starting from a basic position in which the closing element 2 is arranged outside the receptacle opening 6, beyond the open position. Thus a switching characteristic of the electrical switch 8 represents a hysteresis in relation to the current position of the actuation element 23.

Figure 8:
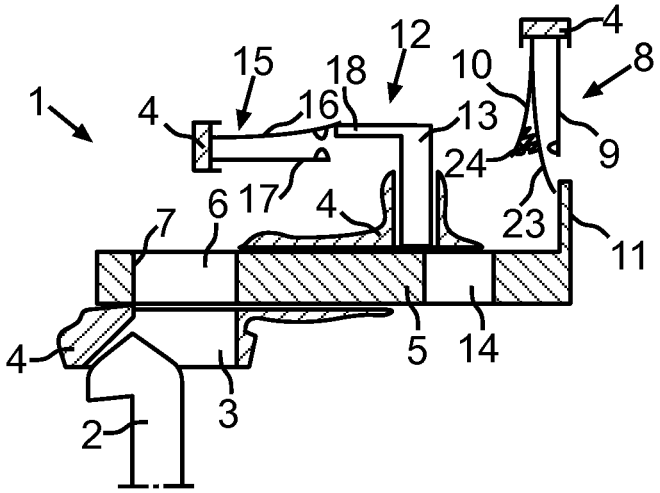
FIG. 8 to FIG. 15 a closing process of the door of a household appliance for a door locking device according to a form of embodiment of the present invention.
Figure 9:
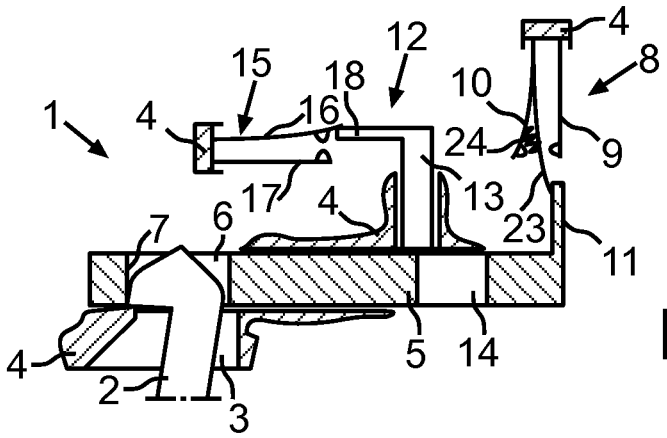
Figure 10:
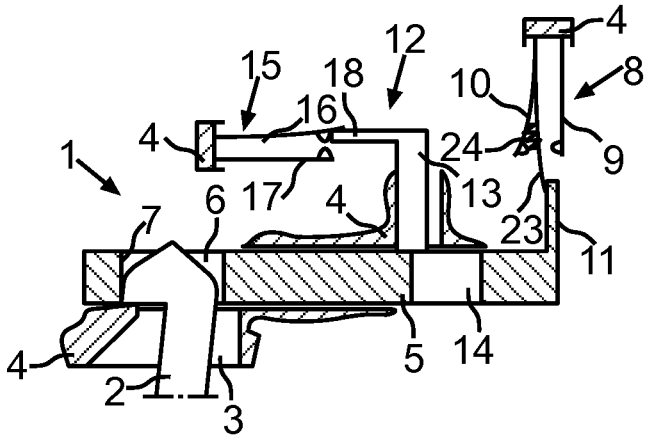
Figure 11:
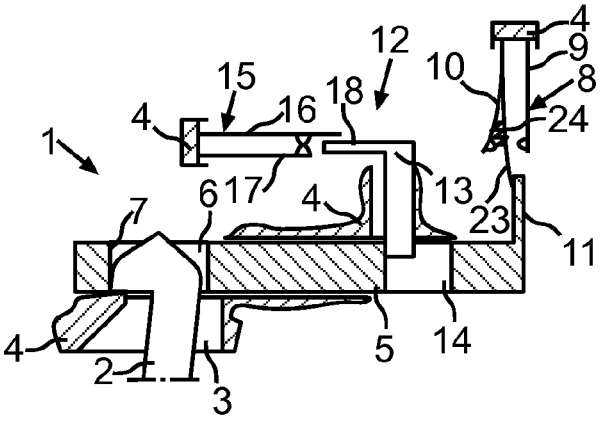
Figure 24:
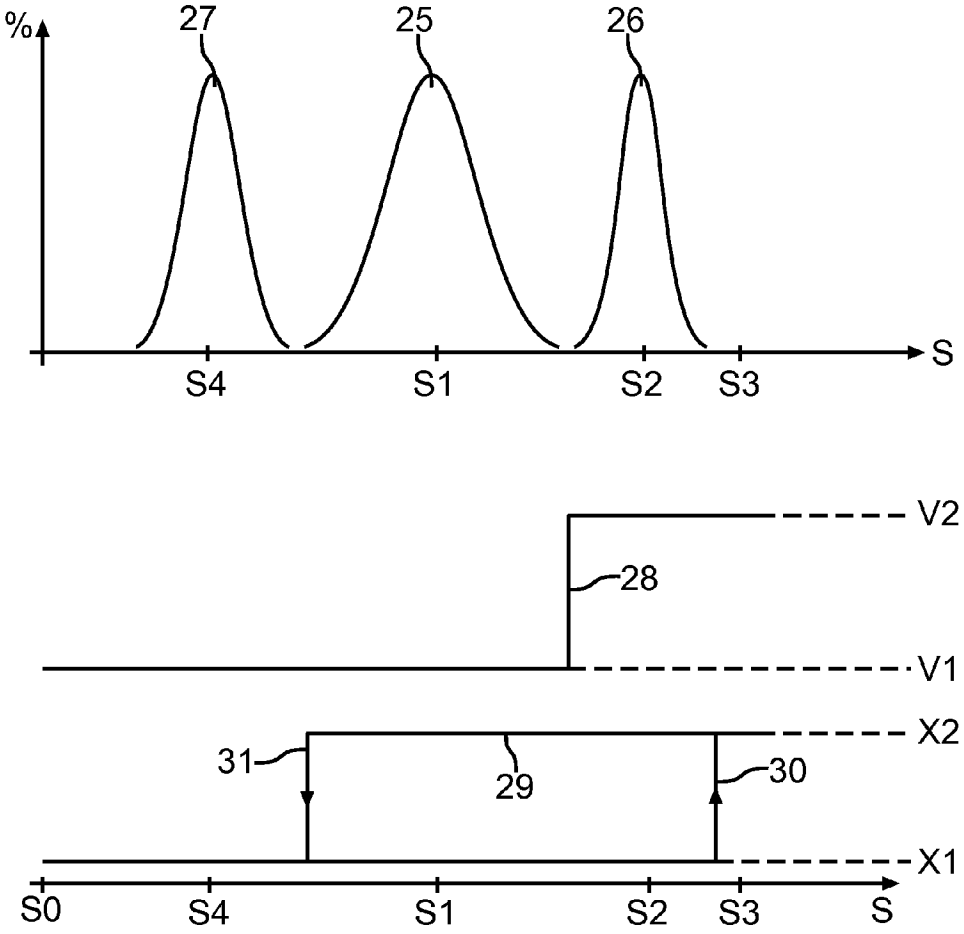
FIG. 24 a curve of a probability density of a probability of reaching an open position, an interlock position and a closed position, a graph of a curve characterizing the possibility of mechanical interlocking as well as a graph of a hysteresis switching characteristic of an electrical switch during operation of the door locking device according to the form of embodiment of the present invention.

Referring to FIG. 8, the closing element 2 embodied as a hook element is arranged outside the receptacle opening 6 of the sliding element 5 and thus the door of the household appliance is open. In this position of the closing element 2 in accordance with FIG. 8, the electrical switch 8 is open and the mechanical interlocking of the door is not possible because of the position of the opening 14 of the interlocking device 12 shifted in relation to the interlocking element 13. Using this position of the closing element 2 as its starting point, the closing process of the door is now described in greater detail. FIG. 9 reflects a further position of the closing element 2 in which the closing element 2 is already located within the receptacle opening 6 of the sliding element 5 and is exerting a force on the side wall 7 of the receptacle opening 6. In this position the mechanical locking of the door is not yet guaranteed and the electrical switch 8 is open. In FIGS. 10 and 11 a further position of the closing element 2 and thus a further position of the sliding element 5 in relation to the base member 4 are shown, in which, although the electrical switch 8 is open, the mechanical interlocking is made possible if necessary, namely depending on component tolerances, especially the shape and position tolerances of the opening 14 of the sliding element 5 and of the interlocking element 13. The mechanical interlocking of the door, i.e. the introduction of the interlocking element 13 into the opening 14 of the sliding element 5, is made possible in an interlock position of the closing element 2. Reference is made here to FIG. 24, in which a Gaussian curve 25 is shown which characterizes a probability density of a probability of reaching the interlock position as a function of the actual position S of the closing element 2 and thus of the sliding element 5. S1 in FIG. 24 designates a position of the sliding element 2 in which the interlock position is highly likely to have been reached.

Figure 12:
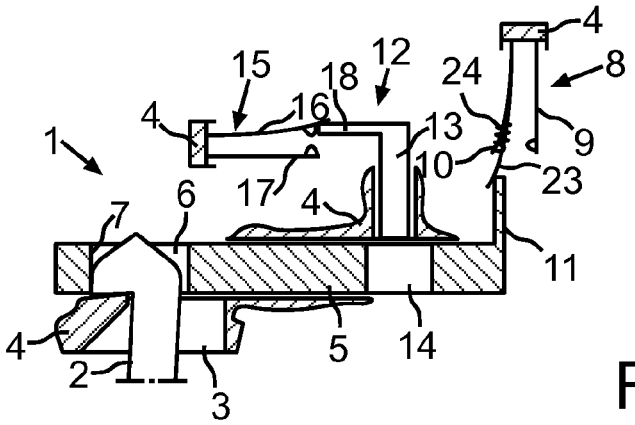
Figure 13:
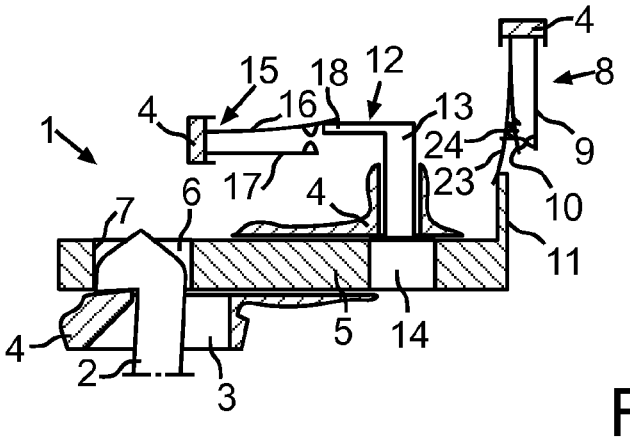

In FIGS. 12 and 13 a further position of the closing element 2 or of the sliding element 5 is shown in relation to the base member 4 and the receptacle 3, in which the mechanical interlocking of the door is securely made possible by means of the interlocking device 12. In this position the electrical switch 8 can if necessary be closed, i.e. depending on the component tolerances, here as a function of the shape and positional tolerances of the flange-type projection 11 and also the actuation element 23. If a closed position of the closing element 2 is reached, the electrical switch 8 will be switched into its closed position. Referring once again to FIG. 24, a Gaussian curve 26 represents a probability density of a probability with which the closed position of the closing element 2 will be reached as a function of the current position S. S2 in FIG. 24 designates a position of the closing element 2 in which there is a high probability of the closed position being reached.

Figure 14:
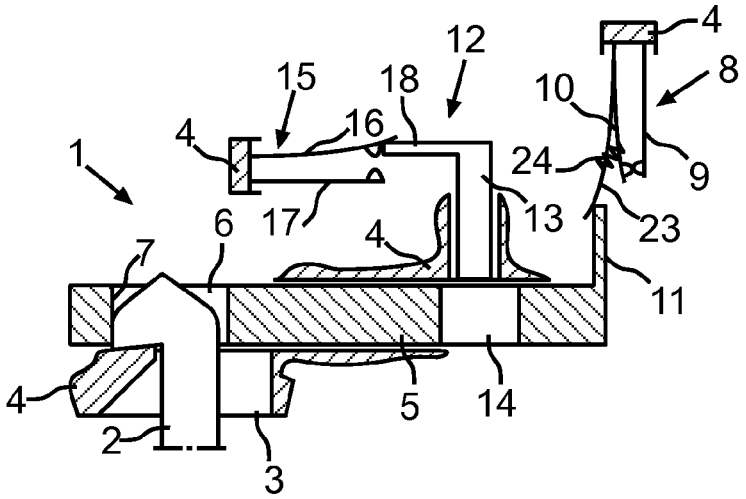
Figure 15:
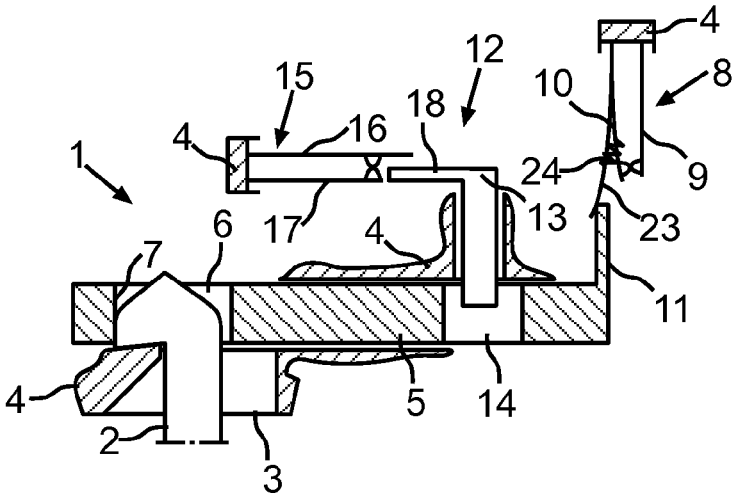

FIGS. 14 and 15 show an end position of the closing element 2 and of the sliding element 5 in relation to the base member 4 in which both the mechanical locking of the door is safely made possible and the electrical switch 8 is also closed. The possibility of interlocking the door is illustrated in FIGS. 14 and 15 on the basis of the different positions of the interlocking element 13. This end position of the closing element is labeled S3 in FIG. 24.

Figure 16:
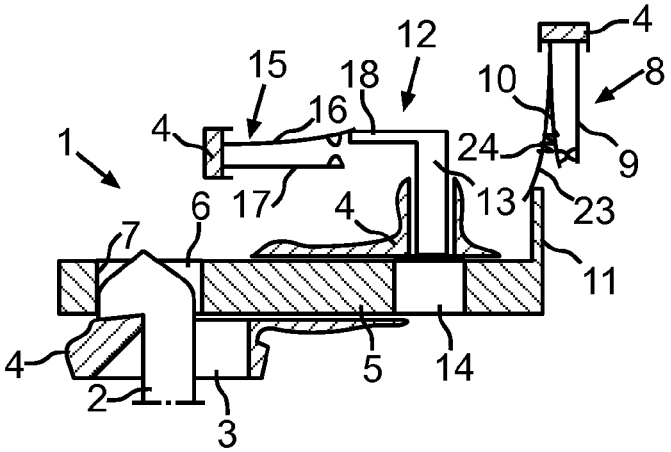
FIG. 16 to FIG. 23 an opening process of the door of the household appliance in the door locking device according to a form of embodiment of the invention.
Figure 17:
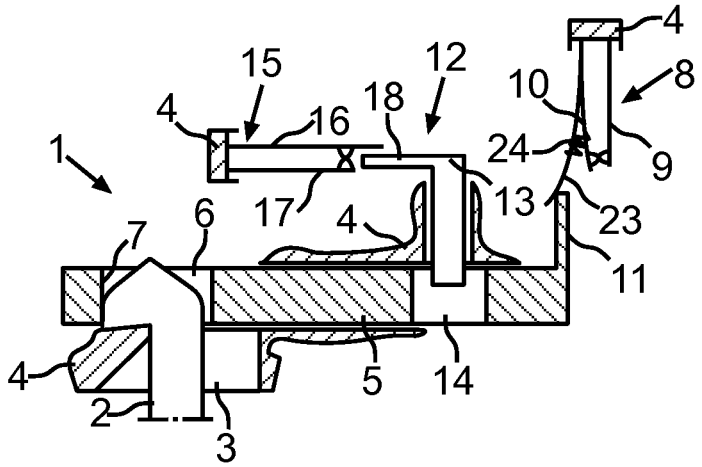
Figure 18:
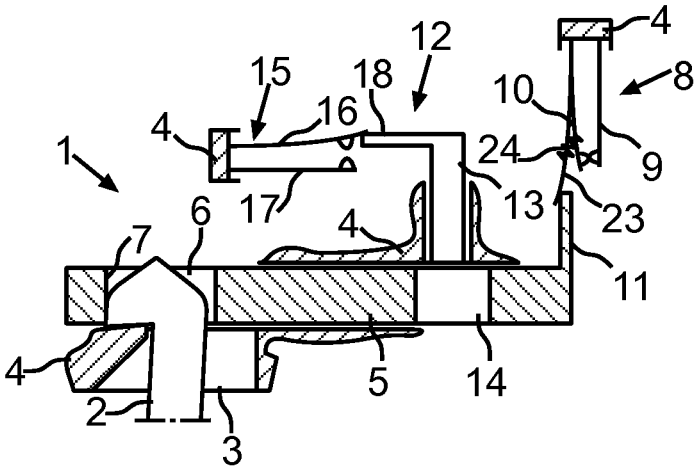
Figure 19:
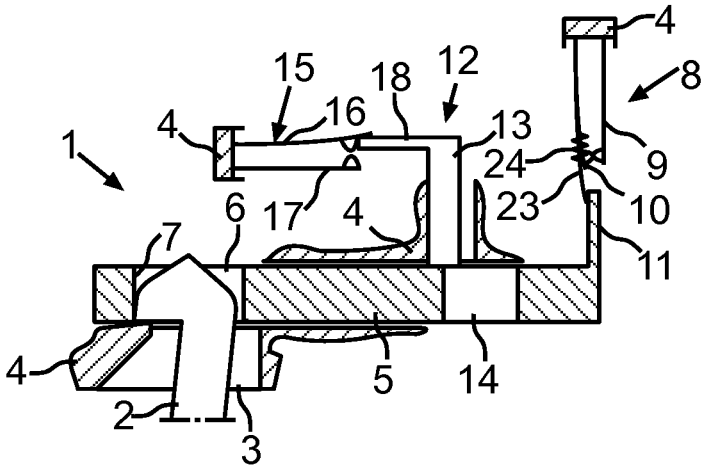
Figure 20:
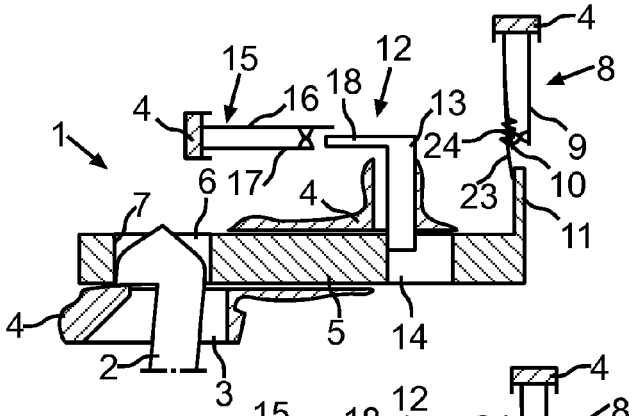

With reference to FIGS. 16 to 23 the opening process of the door is now explained in greater detail. In FIGS. 16 and 17 the closing element 2 is still shown in its end position in which both the mechanical interlocking is made possible and the electrical switch 8 is also closed. In a further position of the closing element 2 in accordance with FIG. 18 the mechanical locking is still guaranteed and the electrical switch 8 is in its closed switching state. A further position of the closing element 2 is shown in FIGS. 19 and 20. In this position the electrical switch 8 is still securely closed, with the mechanical unlocking of the door possibly, i.e. depending on the component tolerances and above and beyond this on the friction between the interlocking element 13 and a sidewall of the opening 14, being made possible.

Figure 21:
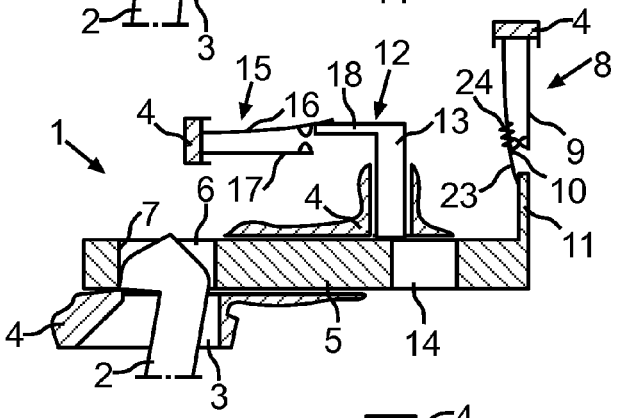
Figure 22:
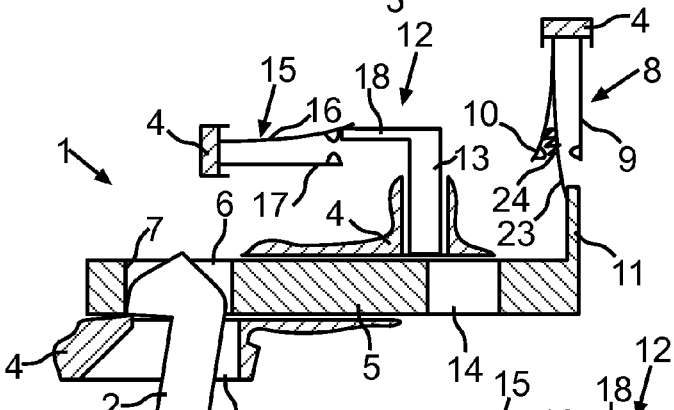

Shown in FIGS. 21 and 22 is a position of the closing element 2 and of the sliding element 5 in which the mechanical interlocking and/or unlocking of the door is no longer possible and the electrical switch 8 is closed or open depending on the component tolerances. If the electrical switch 8 is switched into its open switching state, an open position of the closing element 2 and of the sliding element 5 is reached. Referring to FIG. 24, a Gaussian curve 27 shows a probability density of a probability with which the open position of the closing element 2 will be reached as a function of the current position S when the door is opened. S4 in this figure designates a position of the closing element 2 in which there is a high probability of the open position having been reached.

Figure 23:
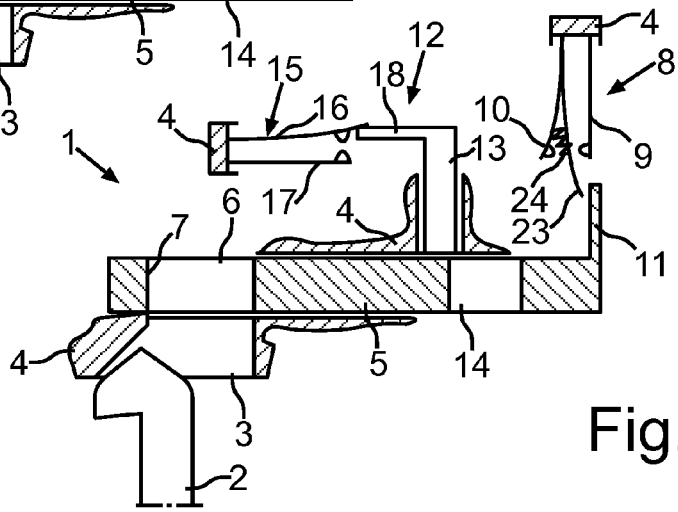

A last position of the closing element 2 in which the mechanical locking of the door is no longer possible and the electrical switch 8 is open, is shown in FIG. 23.

Referring once more to FIG. 24, a curve 28 represents an interlocking characteristic of the interlocking device 12 as a function of the current position S of the closing element 2. In this case the curve 28 can assume two values, a value V1 and a value V2. If the value V1 is assumed, the mechanical interlocking of the door by means of the interlocking device 12 is not possible. If on the other hand the value V2 is assumed, the mechanical interlocking the door by means of the interlocking device 12 is made possible with a probability equal to almost one. In FIG. 24 a switching characteristic of the electrical switch 8 embodied as a spring switch is shown with the aid of a hysteresis 29 as a function of the current position S of the closing element 2. In this figure the open switch state of the electrical switch 8 is labeled with a value X1 and the closed switch position of the electrical switch 8 is labeled with a value X2. The hysteresis 29 exhibits a rising edge 30 which represents the switching of the electrical switch 8 into its closed switching state. A falling edge 31 on the other hand corresponds to switching the electrical switch 8 into its open switching state. As shown, the rising edge 30, i.e. the closed position of the closing element 2 lies on the path coordinates of the closing element 2 and thus of the sliding element 5 including the flange-type projection 11 i.e. in relation to the current position S of the closing element 2, starting from a starting point S0 beyond the falling edge 31, i.e. beyond the open position of the closing element 2.

Through this switching characteristic of the electrical switch 8 embodied as a spring switch a door locking device 1 is advantageously created in which, on closing the door, the mechanical interlocking is first made possible and subsequently the electrical switch 8 is switched into its closed switching state and in which, on opening the door, first the interlock position is passed and subsequently the electrical switch 8 is switched into its open switching state. The result of this is that both, on an attempt to open the door by an operator, the electrical switch 8 is not unintentionally opened, i.e. the mechanical interlocking of the door is always made possible when the electrical switch 8 is closed. A secure start of a process of the household appliance, for example a washing cycle, as well as a secure operation of household appliance is thus guaranteed.

The invention claimed is:

1. A door locking device for a household appliance, the door locking device comprising a base member having a receptacle;

a closing element adapted to be on a door of the household appliance, the closing element being moved into the receptacle when the door is closed;

a control unit;

an electrical switch that is switched over after the closing element is in a closed position and via which an information signal signaling the closed position of the closing element is transmitted to the control unit, the electrical switch being configured to open and close by way of the closing element contacting and moving an element of the door locking device; and an interlocking device adapted to mechanically interlock the door;

wherein mechanical interlocking of the door is facilitated in an interlock position of the closing element; and wherein the closing element is moved from the interlock position into the closed position when the door is closed.

2. The door locking device of claim 1, wherein, in a closed position of the closing element, the electrical switch is switched over into a closed switching state.

3. The door locking device of claim 1, wherein, in an open position of the closing element, the electrical switch is switched over when the door is opened, and wherein the closing element is moved from the interlock position into the open position when the door is opened.

4. The door locking device of claim 3, wherein, in an open position of the closing element, the electrical switch is switched over into an open switch state when the door is opened.

5. The door locking device of claim 1, wherein the electrical switch is a spring switch with hysteresis.

6. The door locking device of claim 1, wherein the electrical switch comprises a contact element pair, and wherein one contact element of the contact element pair is connected via a spring element to an actuation element that is actuated at least indirectly by the closing element.

7. The door locking device of claim 1, wherein the element is a sliding element that is moved by the closing element relative to the base member and by which the electrical switch is switched.

8. The door locking device of claim 7, wherein the sliding element has a flange-type projection that protrudes from the sliding element and by means of which the electrical switch is switched.

9. The door locking device of claim 7, wherein the sliding element has a receptacle opening for accepting the closing element, and wherein the sliding element is moved by exerting a force on a side wall of the receptacle opening that is caused by the closing element.

10. The door locking device of claim 7, wherein the interlocking device has an opening that is formed in the sliding element and into which, in the interlock position of the closing element, a corresponding interlocking element is introduced.

11. The door locking device of claim 10, wherein the corresponding interlocking element is a locking bolt.

12. The door locking device of claim 1, further comprising an electrical interlocking switch that is switched into a closed switching state when the door is interlocked.

13. The door locking device of claim 1, wherein the household appliance is a laundry care household appliance.

14. A door arrangement for a household appliance, the door arrangement comprising:

a door with a closing element; and a household appliance-side door locking device, the door locking device comprising:

a base member having a receptacle into which the closing element on a door side is moved when the door of the household appliance is closed;

a control unit;

an electrical switch that is switched over after the closing element is in a closed position and via which an information signal signaling the closed position of the closing element is transmitted to the control unit, the electrical switch being configured to open and close by way of the closing element contacting and moving an element of the door locking device; and an interlocking device to mechanically interlock the door;

wherein mechanical interlocking of the door is facilitated in an interlock position of the closing element; and wherein the closing element is moved from the interlock position into the closed position when the door is closed.

15. The door locking device of claim 1, wherein the electrical switch is actuated by way of movement of the closing element within the receptacle.

16. The door locking device of claim 1, wherein a switching characteristic of the switching element has hysteresis in relation to a current position of the closing element.

17. The door locking device of claim 16, further comprising an actuation element that actuates the electrical switch and the hysteresis is caused by the actuating element.

18. The door locking device of claim 14, wherein the electrical switch is actuated by way of movement of the closing element within the receptacle.

19. The door locking device of claim 14, wherein a switching characteristic of the switching element has hysteresis in relation to a current position of the closing element.

* * * * *